US006729476B1

(12) United States Patent
Sjoholm

(10) Patent No.: US 6,729,476 B1
(45) Date of Patent: May 4, 2004

(54) OSCILLATOR APPARATUS FOR SORTING OUT PIECES OF LUMBER

(76) Inventor: Robert W. Sjoholm, 109 Mades Dr., Fort Piece, FL (US) 34947

( * ) Notice: Subject to any disclaimer, the term of this patent is extended or adjusted under 35 U.S.C. 154(b) by 0 days.

(21) Appl. No.: 10/200,678

(22) Filed: Jul. 23, 2002

(51) Int. Cl.[7] ..... B07C 5/14

(52) U.S. Cl. ..... 209/517; 209/674; 209/675; 209/341; 209/342; 209/344

(58) Field of Search ..... 209/674, 675, 209/517, 677, 341, 342, 344, 415, 600, 660, 670, 682

(56) References Cited

U.S. PATENT DOCUMENTS 5,746,322 A * 5/1998 LaVeine et al. ..... 209/393

* cited by examiner

*Primary Examiner*—Donald P. Walsh
*Assistant Examiner*—Jonathan R Miller

(57) ABSTRACT

An oscillator apparatus for sorting out pieces of lumber for separating smaller scraps of wood from larger usable pieces of wood. The oscillator apparatus for sorting out pieces of lumber includes a base assembly including leg members and elongate side members interconnecting pairs of leg members; and also includes a table assembly being movably mounted upon the base assembly; and further includes an oscillator assembly being mounted to the base assembly for oscillating the table assembly.

2 Claims, 4 Drawing Sheets

OSCILLATOR APPARATUS FOR SORTING OUT PIECES OF LUMBER

BACKGROUND OF THE INVENTION

1. Field of the Invention

The present invention relates to oscillating sorters and more particularly pertains to a new oscillator apparatus for sorting out pieces of lumber for separating smaller scraps of wood from larger usable pieces of wood.

2. Description of the Prior Art

The use of oscillating sorters is known in the prior art. More specifically, oscillating sorters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,019,626; U.S. Pat. No. 4,205,751; U.S. Pat. No. 4,887,219; U.S. Pat. No. 2,800,225; U.S. Pat. No. 5,282,501; and U.S. Pat. No. 3,776,378.

While these devices fulfill their respective, particular objectives and requirements, the aforementioned patents do not disclose a new oscillator apparatus for sorting out pieces of lumber.

SUMMARY OF THE INVENTION

The general purpose of the present invention, which will be described subsequently in greater detail, is to provide a new oscillator apparatus for sorting out pieces of lumber which has many of the advantages of the oscillating sorters mentioned heretofore and many novel features that result in a new oscillator apparatus for sorting out pieces of lumber which is not anticipated, rendered obvious, suggested, or even implied by any of the prior art oscillating sorters, either alone or in any combination thereof. The present invention includes a base assembly including leg members and elongate side members interconnecting pairs of leg members; and also includes a table assembly being movably mounted upon the base assembly; and further includes an oscillator assembly being mounted to the base assembly for oscillating the table assembly. None of the prior art discloses oscillators for separating out smaller pieces of wood from the larger more usable pieces of wood.

There has thus been outlined, rather broadly, the more important features of the oscillator apparatus for sorting out pieces of lumber in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new oscillator apparatus for sorting out pieces of lumber which has many of the advantages of the oscillating sorters mentioned heretofore and many novel features that result in a new oscillator apparatus for sorting out pieces of lumber which is not anticipated, rendered obvious, suggested, or even implied by any of the prior art oscillating sorters, either alone or in any combination thereof.

Still another object of the present invention is to provide a new oscillator apparatus for sorting out pieces of lumber for separating smaller scraps of wood from larger usable pieces of wood.

Still yet another object of the present invention is to provide a new oscillator apparatus for sorting out pieces of lumber that is easy and convenient to set up and use.

Even still another object of the present invention is to provide a new oscillator apparatus for sorting out pieces of lumber that effectively and efficiently separates smaller scraps of wood from larger usable wood without user intervention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
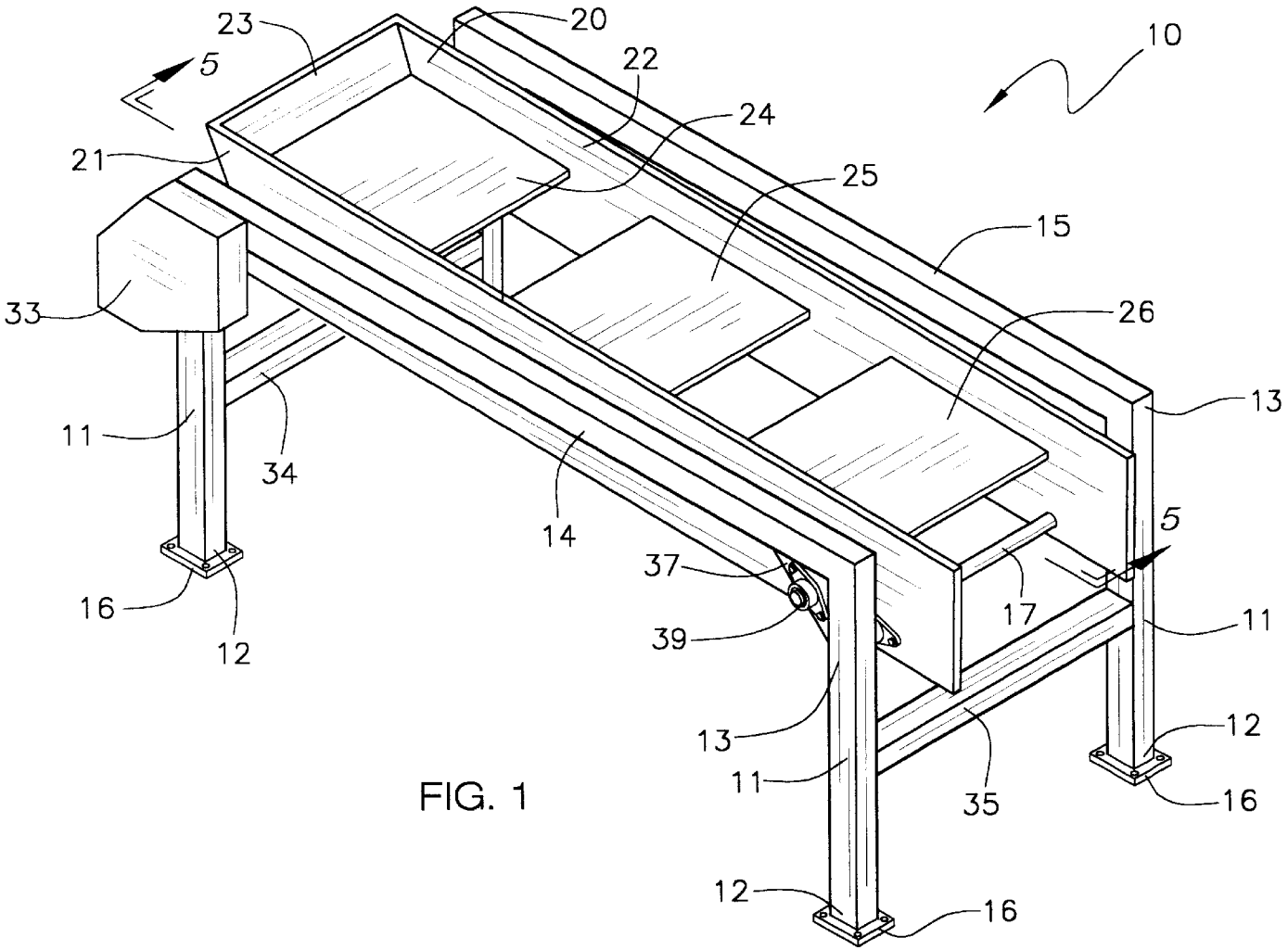
FIG. 1 is a perspective view of a new oscillator apparatus for sorting out pieces of lumber according to the present invention and shown in use.
Figure 2:
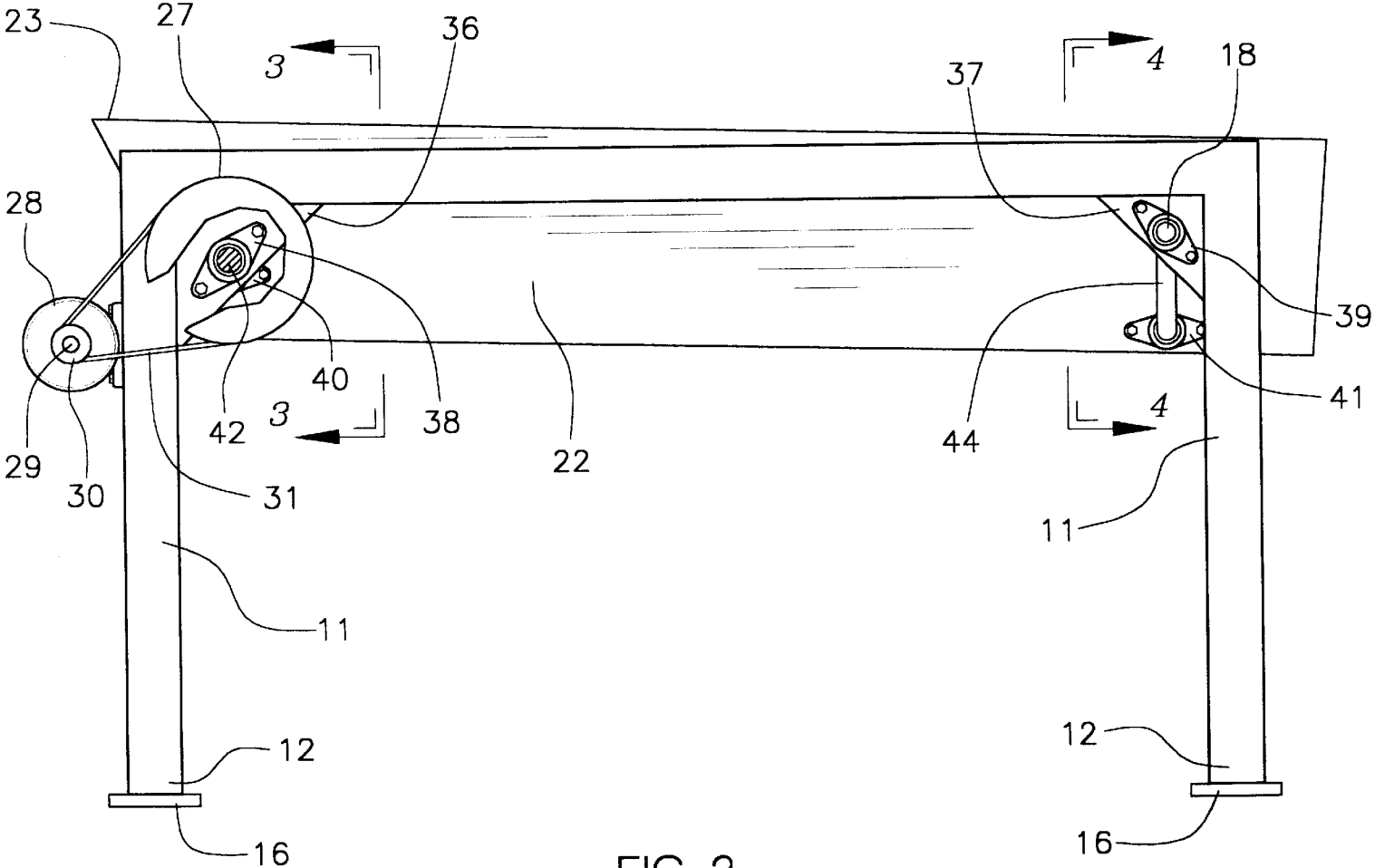
FIG. 2 is a side elevational view of the present invention.
Figure 3:
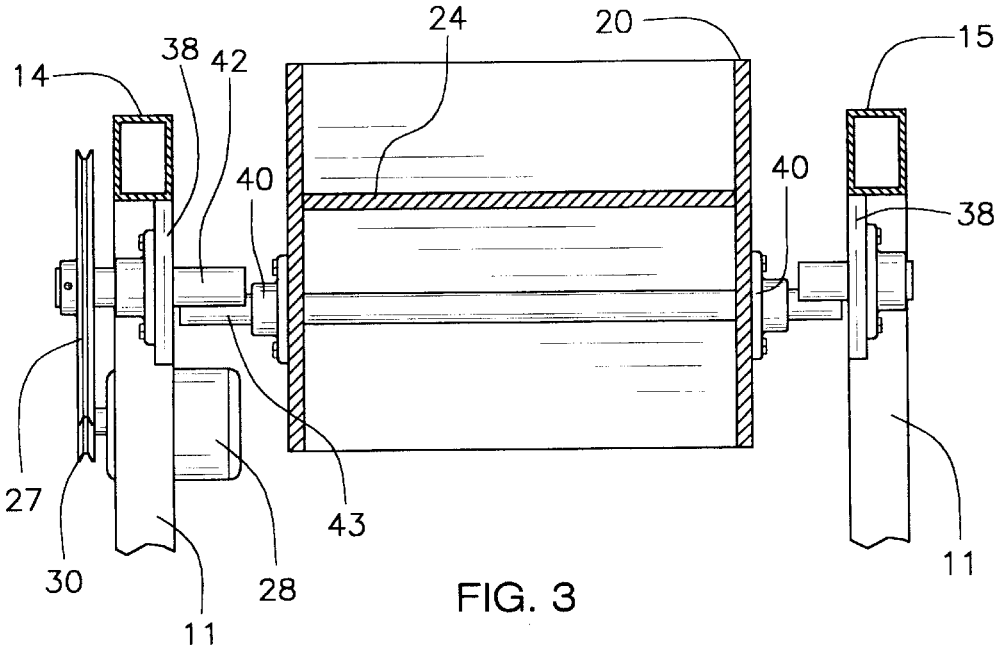
FIG. 3 is a lateral cross-sectional view of the present invention.
Figure 4:
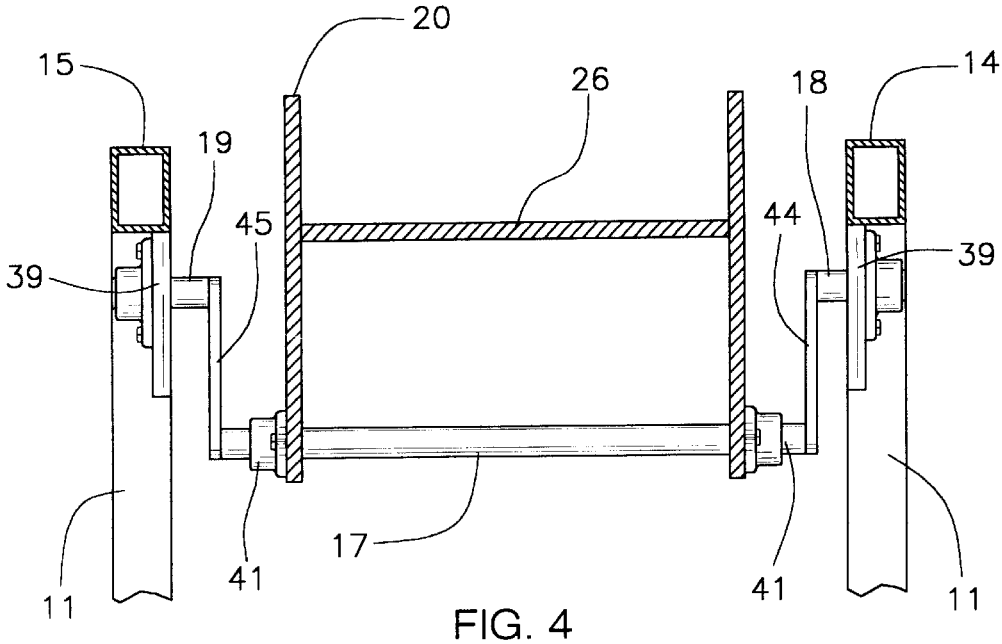
FIG. 4 is another lateral cross-sectional view of the present invention.
Figure 5:
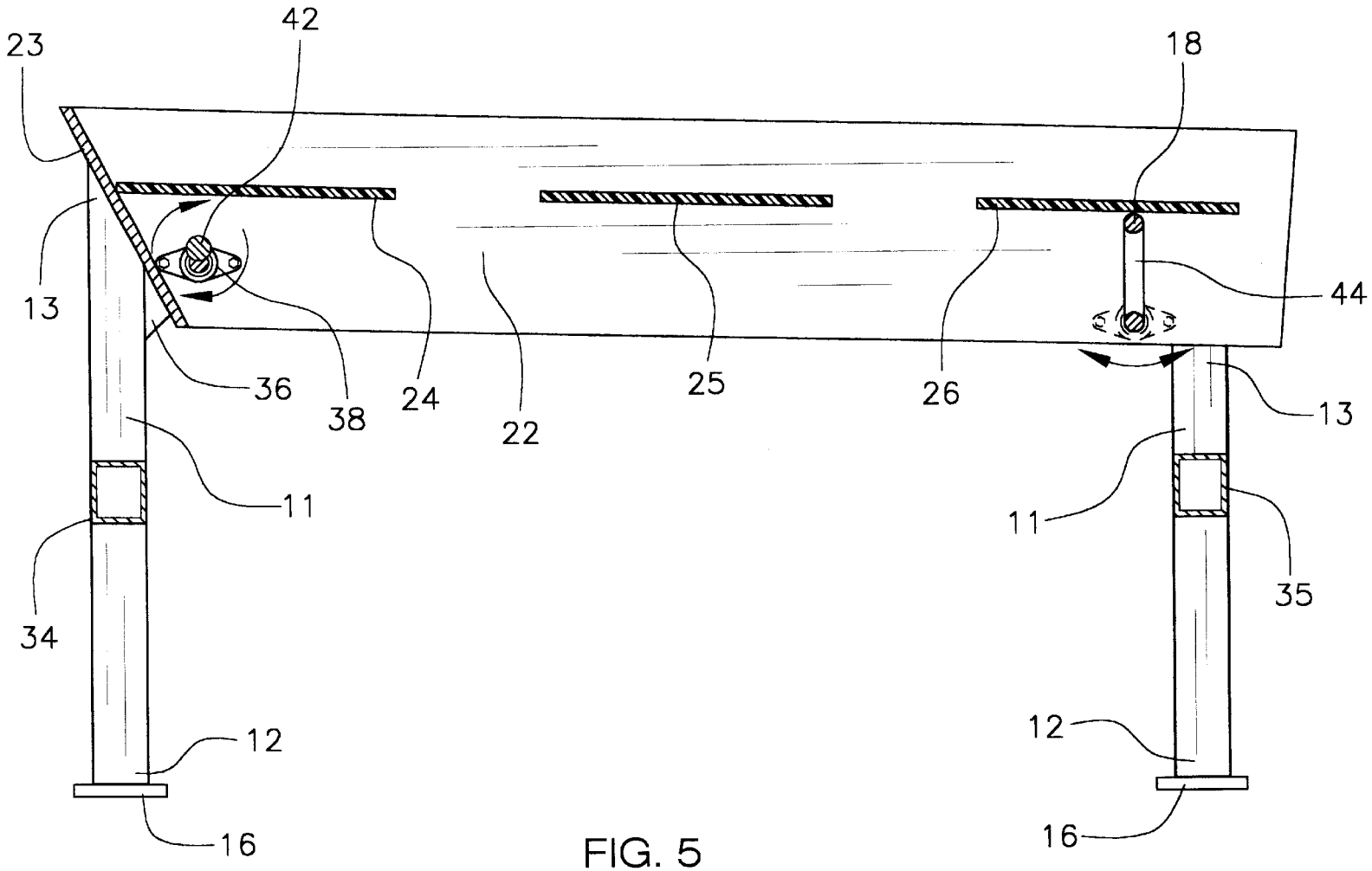
FIG. 5 is a side elevational view of the of the present invention.

With reference now to the drawings, and in particular to FIGS. 1 through 5 thereof, a new oscillator apparatus for sorting out pieces of lumber embodying the principles and concepts of the present invention and generally designated by the reference numeral 10 will be described.

As best illustrated in FIGS. 1 through 5, the oscillator apparatus for sorting out pieces of lumber 10 generally comprises a base assembly including leg members 11 and elongate side members 14,15 conventionally interconnecting pairs of leg members 11. The base assembly further includes feet members 16 being conventionally attached to bottom ends 12 of the leg members 11 and being adapted to be fastened with fasteners to a floor. The base assembly further includes pairs of first and second gusset members 36,37 being conventionally attached to where the elongate side members 14,15 are joined to the leg members 11, and also includes pairs of first and second bearings 38,39 being securely and conventionally disposed in the pairs of first and second gusset members 36,37, and further includes cross members 34,35 conventionally interconnecting pairs of the leg members 11. The elongate side members 14,15 are securely and conventionally attached to top ends 13 of the leg members 11.

A table assembly is movably mounted upon the base assembly. The table assembly is movably mounted upon the first and second shaft members 18,19, and also includes a frame 20 having side rail members 21,22 and an end rail member 23 being conventionally attached to and interconnecting ends of the side rail members 21,22. The end rail member 23 is slanted inwardly from a top end thereof to a bottom end thereof. The table assembly further includes panels 24–26 being longitudinally spaced apart thus forming gaps with the panels 24–26 being conventionally attached in the frame 20 for supporting wood to be sorted with pieces of wood dropping through the gaps.

An oscillator assembly is conventionally mounted to the base assembly for oscillating the table assembly. The oscillator assembly includes pairs of first and second bearing members 40,41 being conventionally disposed in the side rail members 21,22 of the table assembly near the ends thereof, and also includes a camshaft 42 being journaled through the first bearing members 40 and in the first bearings 38 and being in contactable relationship to the table assembly for the oscillation thereof, and further includes an elongate shaft member 17 being journaled through the second bearing members 41, and also includes stub shafts 18,19 being journaled in the second bearings 39, and further includes linkage members 44,45 being conventionally attached to the stub shafts 18,19 and to the elongate shaft member 17 for essentially swinging the table assembly, and also includes a first pulley 27 being conventionally mounted to an end of the camshaft 42, and also includes a motor 28 being conventionally and securely mounted to the base assembly and having a shaft 29 and being connectable to a power source, and further includes a second pulley 30 being conventionally mounted to the shaft 29 of the motor 28, and also includes an endless belt 31 being carried about the first and second pulleys 27,30. The camshaft 42 includes an intermediate portion 43 being generally offset from end portions thereof. The oscillator assembly further includes a cover member 33 being removably and conventionally attached to the base assembly for covering the first and second pulleys 27,30 and the endless belt 31.

In use, the user places wood upon the panels 24–26 and plugs in the motor 28 to actuate rotation of the camshaft 42 causing the table assembly to oscillate back and forth. As the table assembly oscillates, the smaller pieces of wood will drop off the table assembly between the panels 24–26 with the larger more usable wood remaining on the table assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the oscillator apparatus for sorting out pieces of lumber. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An oscillator apparatus for sorting out pieces of lumber wherein comprising:

a base assembly including leg members and elongate side members interconnecting pairs of said leg members, said base assembly further including pairs of first and second gusset members being attached to where said elongate side members are joined to said leg members, and also including pairs of first and second bearings being securely disposed in said pairs of said first and second gusset members, and further including cross members interconnecting pairs of said leg members;

a table assembly being movably mounted upon said base assembly, and also including a frame having side rail members and an end rail member being attached to and interconnecting ends of said side rail members, said table assembly further including panels being longitudinally spaced apart thus forming gaps, said panels being attached in said frame for supporting wood to be sorted with pieces of wood dropping through said gaps; and an oscillator assembly being mounted to said base assembly for oscillating said table assembly, said oscillator assembly includes including pairs of first and second bearing members being disposed in said side rail members of said table assembly near ends thereof, and also includes including a camshaft being journaled through said first bearing members and in said first bearings and being in contactable relationship to said table assembly for the oscillation thereof, and further includes including an elongate shaft member being journaled through said second bearing members and also includes including stub shafts being journaled in said second bearings, and further includes including linkage members being attached to said stub shafts and to said elongate shaft member for essentially swinging the table assembly, and also includes including a first pulley being mounted to an end of said camshaft, and also includes including a motor being mounted to said base assembly and having a shaft and being connectable to a power source, and further includes including a second pulley being mounted to said shaft of said motor, and also includes including an endless belt being carried about said first and second pulleys, said camshaft having an intermediate portion being generally offset from end portions thereof thus causing oscillation of said panels.

2. The oscillator apparatus for sorting out pieces of lumber as described in claim 1, wherein said oscillator assembly further includes a cover member being removably attached to said base assembly for covering said first and second pulleys and said endless belt.

* * * * *